United States Patent [19]

Sjunnesson

[11] Patent Number: 4,631,941

[45] Date of Patent: Dec. 30, 1986

[54] CYLINDER LOCK WITH PERMISSIBLE SERVICE ENTRY

[75] Inventor: Bengt O. Sjunnesson, Oxie, Sweden

[73] Assignee: GKN-Stenman AB, Eskilstuna, Sweden

[21] Appl. No.: 684,416

[22] Filed: Dec. 20, 1984

[30] Foreign Application Priority Data

Dec. 22, 1983 [SE] Sweden ..... 8307139

[51] Int. Cl.[4] ..... F05B 35/10

[52] U.S. Cl. ..... 70/337; 70/358; 70/364 A; 70/389; 70/421

[58] Field of Search ..... 70/337–343, 70/386, 358, 389, 390, 421, 364 A, 378, 392

[56] References Cited

U.S. PATENT DOCUMENTS

| | | | |
|---|---|---|---|
| 396,628 | 1/1889 | Van Hoevenbergh | 70/337 |
| 1,070,367 | 8/1913 | Voight | 70/340 |
| 1,707,922 | 4/1929 | Pepper | 70/421 |
| 1,922,438 | 8/1933 | Hurd | 70/337 |
| 2,911,816 | 11/1959 | Jones et al. | 70/386 |
| 3,590,615 | 7/1971 | Schultz | 70/358 X |
| 4,069,694 | 1/1978 | Raymond et al. | 70/337 |
| 4,300,374 | 11/1981 | Mullich et al. | 70/134 X |

FOREIGN PATENT DOCUMENTS

| | | | |
|---|---|---|---|
| 268927 | 2/1969 | Austria | 70/421 |
| 0147377 | 7/1985 | European Pat. Off. | 70/63 |
| 793880 | 10/1980 | Norway . | |
| 53649 | 1/1923 | Sweden | 70/358 |

*Primary Examiner*—Robert L. Wolfe
*Assistant Examiner*—Lloyd A. Gall
*Attorney, Agent, or Firm*—Sughrue, Mion, Zinn, Macpeak and Seas

[57] ABSTRACT

A cylinder lock (1) has a normal locking mode (12 o'clock position) and a service locking mode (10 o'clock position). When the cylinder plug (3) is left in the service mode of the lock, with the aid of a standard key, the lock can be turned with the aid of a service key (9). The service key is latched against withdrawal in the normal mode of the lock, by means of an intermediate pin (7') of larger diameter than a corresponding upper pin (4) in the normal mode of the lock. The intermediate pin can be received in a widened part (3b') of a corresponding pin-channel (3a') in the cylinder plug, but is unable to enter the pin channel (2a) of the cylinder housing of smaller diameter, hence latching the service key (9). Subsequent to using the service key (9), the cylinder is returned to the normal locking mode (12 o'clock position) with the aid of the standard key, whereafter the lock can only be opened with the aid of the standard key. Each of the two modes can be defined by a spring-biased ball disposed in a suitable pin-channel and arranged to snap-in a corresponding empty pin-channel in the plug.

4 Claims, 10 Drawing Figures

CYLINDER LOCK WITH PERMISSIBLE SERVICE ENTRY

FIELD OF INVENTION

The present invention relates to cylinder locks of the kind comprising a plug which is mounted for rotation in a plug housing and has a keyway therein for receiving a key, a first row of pin-channels having pins disposed therein and being arranged to co-act with at least two further rows of pin-channels provided in the cylinder housing and having spring-loaded pins disposed therein, of which two further channel-rows one corresponds to a normal lock position in which a standard key can be inserted into the keyway and the plug turned, and a second channel-row is positioned at an angle to the first, this angled position corresponding to a service position in which a service key can be inserted in the keyway and the plug turned, the arrangement being such that while the standard key can be inserted into the keyway with the pin-channels in the service position, the service key is latched against withdrawal in a normal lock position.

Such locks have the advantage that a person with access to a service key, for example a janitor or like attendant with respect to a block of flats, can obtain access to an apartment with the aid of the key, but only if the occupier of the apartment so permits. When the occupier of an apartment is willing for the janitor or like person to enter the apartment during his/her absence, he/she turns the lock to the service position when leaving the apartment, so that the attendant is able to enter with the aid of the service key.

When leaving the flat, however, the attendant is unable to turn the plug to the normal lock position, since he/she is unable to remove the key from the lock with the plug in this position.

When the occupier of the apartment leaves the lock in the normal lock position, it is not possible to enter the apartment with the aid of the service key. Although in some cases it is possible to insert the service key into the keyway, one or more pins in the passage ways or channels will prevent rotation of the lock plug.

The plug can be turned with the standard key, however, irrespective of whether the lock is in its normal position or in its service position.

BACKGROUND ART

Various lock designs are found which utilize the principles of the aforedescribed arrangement. For example, U.S. Pat. No. 1,070,367 (Voight) describes a cylinder lock having an additional functional position for a special key. When the plug occupies this additional functional mode, access can be had to the apartment or room, solely with the aid of this special key. In the preferred embodiment, an upper pin located in a pin-channel in the row of channels in the additional functional mode has an upwardly extending peg, which causes the pin to engage the roof of the plug housing, thereby to prevent the plug from being turned with any key other than the aforesaid special key, when the plug occupies with additional functional position.

A lock of this design is unsatisfactory, however, since it is a relatively simple matter to file a substitute key so that the part of the key co-acting with the studded pin is able to move the same in a manner to enable the plug to be turned. Thus, a standard key can readily be converted to the aforesaid special key, and be used to gain entry to the apartment, even when the lock is turned to the additional functional mode.

Published Norwegian patent application No. 793880 (Elkem-Spigerverket) describes a similar arrangement in which the number of pin-channels in the normal lock position differ from the number of pin-channels operative in the additional functional mode or service mode thereof, thereby enabling the key to be locked. Blocking of the key is effected by excluding the presence of certain pin-channels for upper pins in one of the said lock positions, so as to prevent the lower pin or pins from moving upwardly in this position. This lock also has the same disadvantage as the lock previously described, since it is a simple matter to modify a standard key to fit the lock and function in the additional or service mode, thereby overriding the design latching effect.

U.S. Pat. No. 4,300,374 (Mullich et al) describes a similar lock arrangement, although in this case the special key has limited manouverability.

U.S. Pat. No. 1,922,438 (Hurd) describes an arrangement in which pin-sections can be tipped over in a manner to retain the key.

One disadvantage with the majority of the aforementioned known lock designs is that they can readily be forced. This applies, for example, to the described Norwegian lock design, when one has pre-knowledge of the particular pin-channel which does not co-act with a pin-channel in the plug housing. Another disadvantage is that the service key can readily be filed to fit the lock in its normal lock position.

OBJECT OF THE INVENTION

An object of the invention is to provide an arrangement in a cylinder lock of the aforesaid kind, with which the disadvantages inherent with similar known lock designs are avoided; which cannot be readily forced; and which does not provide the possibility of opening the lock with the plug in the normal lock position with the aid of a modified service key.

Another object of the invention is to provide a cylinder lock of simple design and low cost with respect to necessary ancillary devices which, despite its simplicity, is highly reliable and burglar-safe.

BRIEF DISCLOSURE OF THE INVENTION

A lock arrangement according to the present invention is characterized in its widest aspect substantially in that intermediate pins are arranged additional to upper pins in one or more of the pin-channels of the plug housing in the second row of channels corresponding to the service lock position;

that the diameter of one such intermediate pin is greater than a corresponding upper pin is said second row; and that corresponding pin-channels in the plug have a widened upper part capable of accommodating said intermediate pin of larger diameter.

Among other things, the invention affords the advantage that the service key is effectively latched in the normal lock position, without it being possible to know beforehand which of the pin-channels accommodates the intermediate pin effecting the latching action. This makes it more difficult to file the service key to a form in which it is not latched in the normal lock position.

A further advantage is that it is comparatively simple to provide a pin-channel of larger diameter than remaining channels, and to provide the cylinder plug with a flared or widened portion capable of receiving an intermediate pin of said larger diameter.

Thus, with a lock of this design, when attempting to withdraw the service key in the normal lock position the intermediate pin will strike against the overlying narrower pin-channel in the plug housing, i.e. without being able to move upwardly therein, thereby effectively latching the key against withdrawal.

Several of the pin-channels in said second row, i.e. corresponding to the service position, can be provided with intermediate pins which render forcing of the lock difficult. The position of the pin-channel of larger diameter may also be varied, thereby making the task of focing the lock even more difficult.

In the normal lock position, the coinciding pin-channels in the cylinder housing and plug respectively solely accommodate upper and lower pins respectively, i.e. the intermediate pins are omitted in this case. The form and design of these pins, however, can be varied in a conventional manner. For example, both the upper and lower pins may comprise various types of safety pin, pins having hardened cores, and so-called pear-shaped pins.

In practice it is preferred that the intermediate-pin accommodating pin-channel of larger diameter in the plug housing also accommodates an upper pin of the same diameter as the intermediate pin.

The service position can be defined by a spring-biased ball disposed in a suitable pin-channel in said second row and arranged to snap-into a co-acting pin-channel in the plug, said co-acting channel preferably being an empty channel.

The normal lock position can also be defined in a corresponding manner.

An embodiment of the invention will now be described in more detail with reference to the accompanying drawings.

A PREFERRED EMBODIMENT OF THE INVENTION

Figure 1:
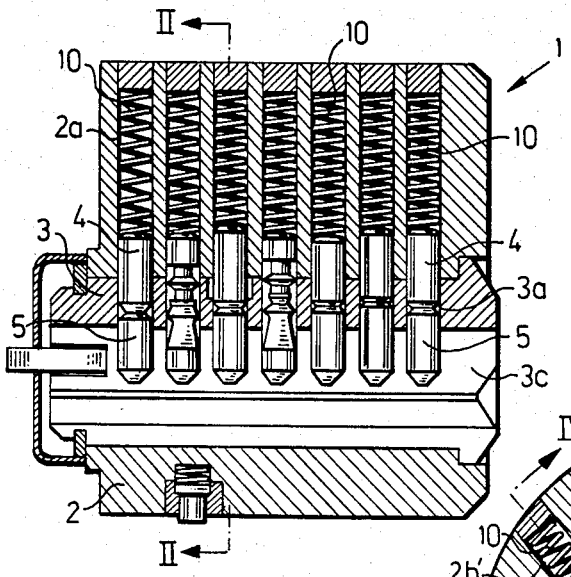
FIG. 1 is a sectional view through a cylinder lock provided with an arrangement according to the invention, and illustrates the cylinder plug in its normal lock position.
Figure 2:
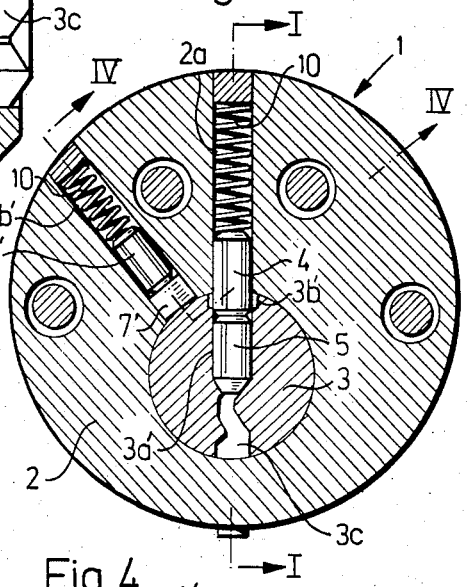
FIG. 2 is a sectional view taken on the line II—II in FIG. 1.

Referring first to FIGS. 1–4 there is illustrated a cylinder lock 1 having a cylinder housing 2 which has a cylinder plug 3 disposed for rotation therein. The cylinder housing is provided with two rows of pin-channels, namely one row of pin-channels corresponding to the normal locking mode of the cylinder plug (the 12 o'clock position). These pin-channels are referenced *2a* and, as illustrated in FIG. 1, accommodate upper pins 4 biased by springs 10, said upper pins being of mutually different configuration and having mutually different characteristics. Thus, some of these pins are provided with hardened cores, to render drilling of the cores difficult.

In a corresponding manner the cylinder plug 3 is provided with a row of pin-channels *3a* accommodating lower pins 5, which similar to the upper pins having mutually different configurations and characteristics.

The keyway of the cylinder plug is referenced *3c*.

The housing 2 is also provided with a second row of pin-channels, here referenced *2b*. A plane extending through the first row of pin-channels is able to form an angle, for example, of 40° with a plane passing through the second row of pin-channels. In other words, the row of pin-channels in the core, with the channels in the 12 o'clock position, coincide with the first row of pin-channels in the cylinder housing, while when the plug channels occupy the 10 o'clock position they coincide with the second row of channels, corresponding to the service mode of the cylinder plug.

Figure 4:
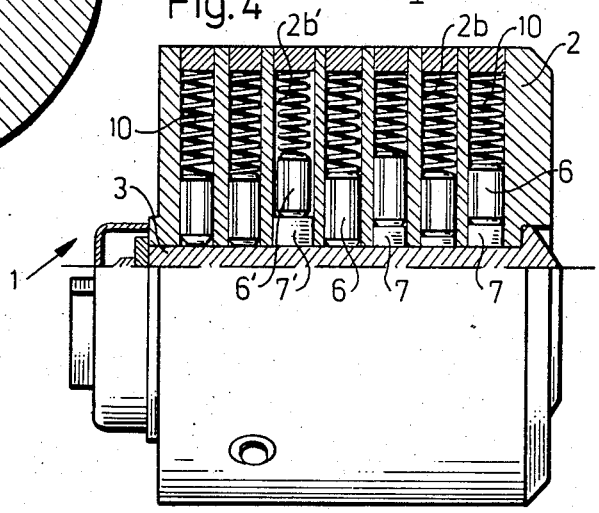
FIG. 4 is a sectional view taken on the line IV—IV in FIG. 2.

As illustrated in FIG. 4, some of the pin-channels *2b* accommodate both upper pins 6 and intermediate pins 7. One of the pin-channels, namely the fifth channel from the mouth of the keyway *3c*, has a larger diameter than remaining pin-channels. This pin-channel is referenced *2b'*. The pin-channel accommodates an upper pin 6' and an intermediate pin 7'. The diameter of the upper pin 6' and the intermediate pin 7' may be as large as 3.5 mm, while the remaining pins have a diameter of about 3 mm.

Figure 7:
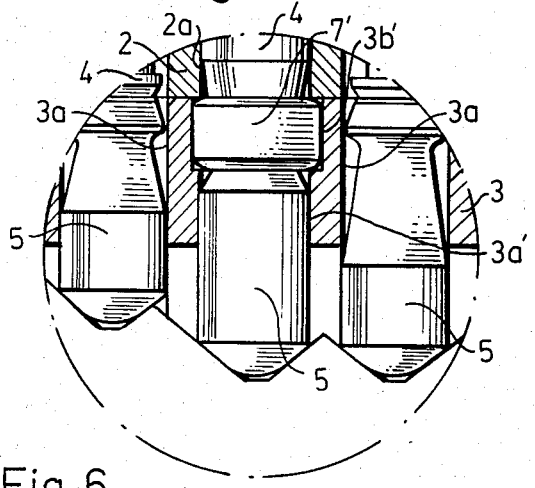
FIG. 7 illustrates in larger scale a part of FIG. 6, namely the intermediate pin of larger diameter operative in latching the service key.
Figure 6:
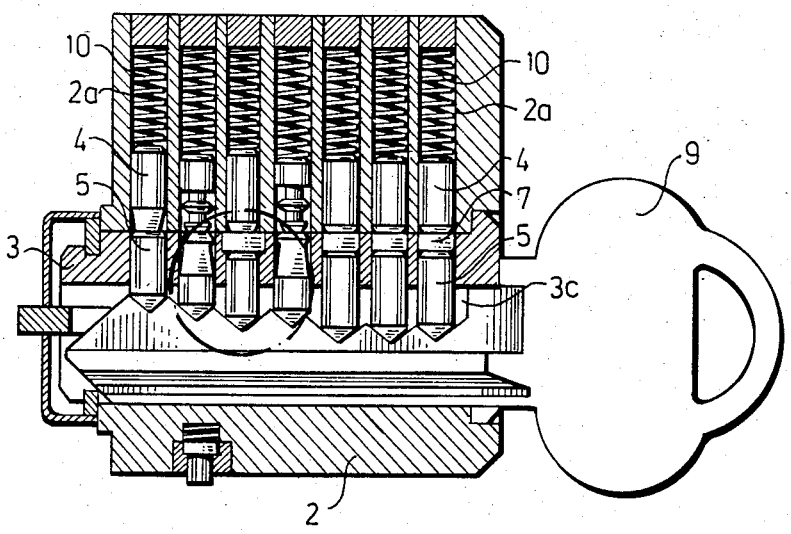
FIG. 6 is a sectional view corresponding to the view of FIG. 5, in which the service key has been inserted into the service position and turned to the normal lock position, whereupon the service key is held latched against withdrawal.

As illustrated in FIGS. 6 and 7, corresponding channels *3a'* in the cylinder plug have a widened portion *3b'* at their upper end, i.e. the end located adjacent the periphery of the cylinder plug, the depth of said widened portion being such as to enable it to accommodate the intermediate pin 7'. It will be seen from FIG. 7 that in this position the intermediate pin 7' is prevented from moving upwardly by an upper pin 4 located in the overlying pin-channel *2a*. Thus, a service key 9 which has been inserted into the cylinder plug in the service mode illustrated in FIG. 3, (the 10 o'clock position), and the plug subsequently turned to the normal lock position (the 12 o'clock position), cannot be withdrawn from the cylinder lock, since such withdrawal is prevented by the intermediate pin 7'.

Figure 5:
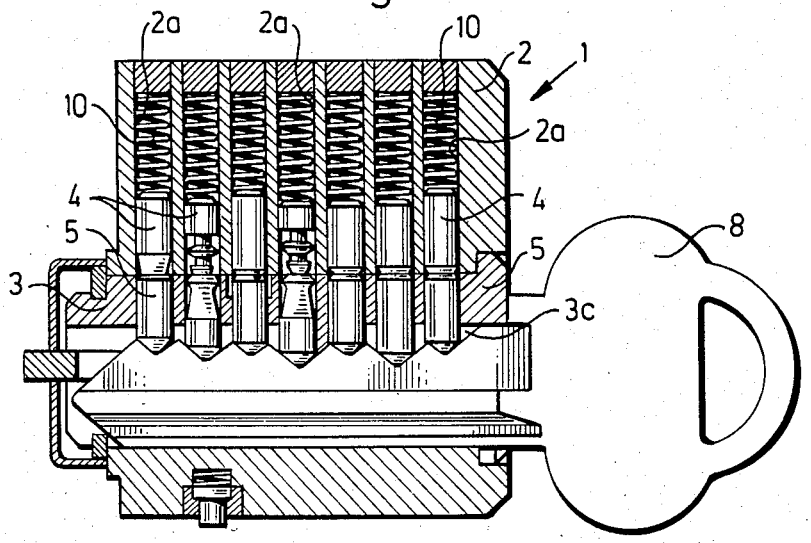
FIG. 5 is a sectional view through the cylinder lock, corresponding to the view of FIG. 1, with a standard key inserted.

FIG. 5 illustrates the situation when an apartment key 8 is inserted into the cylinder plug in the normal lock mode and then turned in the normal manner. In this case, the dividing line or pitch line between the upper pins 4 and the lower pins 5 coincides with the periphery of the cylinder plug.

Figure 3:
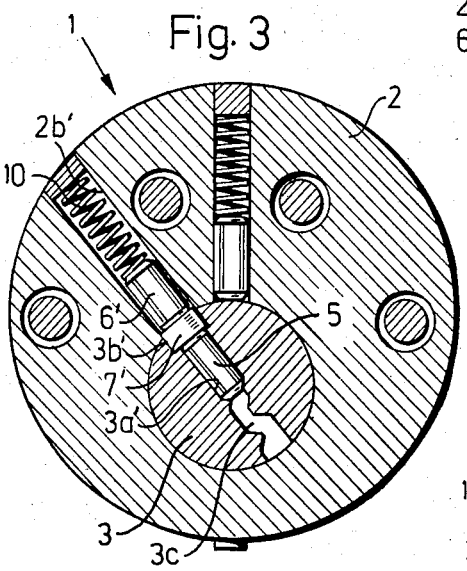
FIG. 3 is a view corresponding to the view of FIG. 2, but with the cylinder plug in its service mode.

When the apartment key 8 is now removed from the cylinder plug in the service mode illustrated in FIG. 3, the upper pin 6′ and the intermediate pin 7′ adopt the position illustrated in said Figure. The service key 9 can be inserted and the plug rotated. In the normal mode of the lock, however, the situation is that described with reference to FIGS. 6 and 7, i.e. the service key 9 is latched against withdrawal.

Figure 8:
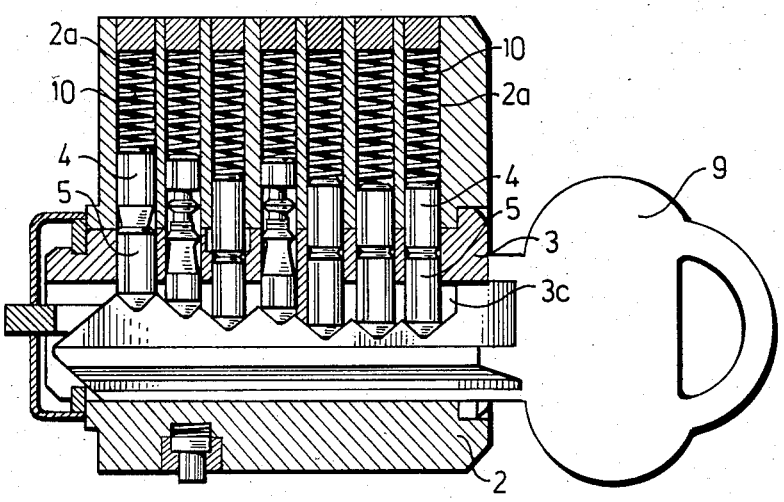
FIG. 8 illustrates the position in which the service key has been inserted into the lock in its normal lock position, whereupon rotation of the cylinder plug is prevented.

FIG. 8 illustrates that although the service key 9 can be inserted into the cylinder plug with the lock in its normal mode, rotation of the plug is prevented by the upper pin 4. The service pin 9 can be readily withdrawn, however.

Figure 9:
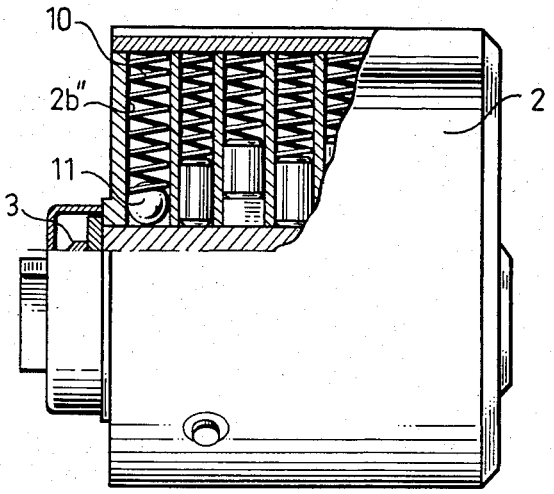
FIG. 9 is a partially cut-away view of a modified embodiment, corresponding to the view in FIG. 4.
Figure 10:
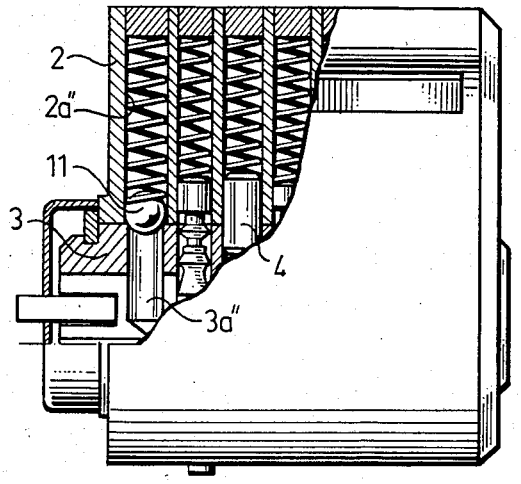
FIG. 10 is an immediate side view of the embodiment illustrated in FIG. 9, with the cylinder plug in the service mode of the lock.

FIGS. 9 and 10 illustrate a modified embodiment. In this modified embodiment, when seen from the mouth of the keyway 3*c* the terminal pin-channel 2*b*″ and 2*a*″ of respective rows of pin-channels, both in the service mode and the normal mode of the lock, lack a pin and are instead provided with a ball 11 whose diameter is slightly smaller than the diameter of the respective pin-channel, so that the ball 11 is able to move readily in the channel, against the action of a spring 10.

A corresponding pin-channel 3*a*″ in the cylinder plug, this pin-channel in the embodiment illustrated in FIGS. 1–8 accommodating a lower pin 5, is empty in the embodiment of FIGS. 9 and 10, thereby enabling the ball 11, when the plug 3 is turned to respective positions by means of the key, to accurately define said position with a snap-in action, and loosely retain the cylinder in this position. In other words, it is not necessary to seek the normal or service mode of the lock, but that the ball 11 snaps-in immediately and accurately defines the position of the cylinder, so that, for example in the service position of the lock, the apartment key 8 can be readily removed and the service key 9 readily inserted.

The service key 9 may be a master key which fits, for example, all apartments in an apartment building or a living area, or alternatively all apartments on one floor of an apartment block. The standard key 8, on the other hand, is preferably not of this kind, i.e. each standard key fits the lock of only one apartment or dwelling house. Thus, in such cases one or more of the pin-channels in the service mode of the lock will accommodate intermediate pins, while the pin-channels in the normal mode of the lock will lack such intermediate pins.

I claim:

1. A cylinder lock system, comprising: a cylinder plug (3) rotatably disposed in a cylinder housing (2) and having arranged therein a keyway (3*c*) and a row of pins (5) individually accommodated in a plurality of pin-channels (3*a*) for co-action with first and second rows of pin-channels (2*a*, 2*b*) defined in the cylinder housing and having individually arranged therein a plurality of spring-biased pins, said first row of pin-channels corresponding to a normal mode position of the lock, and said second rod of pin-channels being disposed at an angle to the first row and corresponding to a service mode position of the lock, a standard key (8) insertable into the keyway, and a service key (9) insertable into the keyway, wherein one of the pin-channels (2*b*′) in said second row accommodates an intermediate in (7′) and an upper pin (6′), said intermediate pin having a larger diameter than upper pins (4) in the first row of pin-channels, a corresponding pin-channel (3*a*′) in the cylinder plug (3) has a widened part (3*b*′) at a radially outer end thereof for fully receiving said larger diameter intermediate pin (7′), said standard key is operable to rotate the cylinder plug in both the normal and service mode positions, said service key is operable to rotate the cylinder plug only in the service mode position, and the larger diameter of the intermediate pin blocks the entry thereof into a narrower first row pin-channel when the cylinder plug is rotated to the normal mode position by the service key to thereby latch the service key against withdrawal.

2. A lock system according to claim 1, wherein the pin-channels (2*a*) in the first row of channels accommodate upper pins (4) having different body configurations.

3. A lock system according to claim 1 wherein only pin-channels (2*b*,2*b*′) in the second row accommodate intermediate pins (7,7′).

4. A lock system according to claim 1, wherein a pin-channel (2*b*″,2*a*″) in the cylinder housing accommodates a ball (11) biased by a spring (10) and arranged to snap into a mating pin-channel (3*a*″) in the cylinder plug (3), said mating pin-channel having no lower pin disposed therein.

* * * * *